US005984361A

United States Patent [19]

Westerman, II et al.

[11] Patent Number: 5,984,361

[45] Date of Patent: Nov. 16, 1999

[54] DEVICE AND METHOD FOR ORGANIZING MATERIALS

[76] Inventors: Frank B. Westerman, II; Carol L. Westerman, both of P.O. Box 2328, Basalt, Colo. 81621

[21] Appl. No.: 09/061,599

[22] Filed: Apr. 16, 1998

Related U.S. Application Data

[60] Provisional application No. 60/044,153, Apr. 23, 1997.

[51] Int. Cl.[6] ..... B42D 1/08

[52] U.S. Cl. ..... 281/22; 40/107; 283/2; 283/3

[58] Field of Search ..... 283/2–4; 40/107; 281/22

[56] References Cited

U.S. PATENT DOCUMENTS

| | | | |
|---|---|---|---|
| 770,354 | 9/1904 | Corfman | 383/39 |
| 962,595 | 6/1910 | Smith | 211/88.01 |
| 3,207,421 | 9/1965 | Hunger et al. | 229/72 |
| 3,290,812 | 12/1966 | Hunkins | 283/2 |
| 4,975,061 | 12/1990 | Avrill | 434/304 |
| 5,257,940 | 11/1993 | Schaarschmidt | 434/304 |
| 5,295,319 | 3/1994 | Jabbar | 40/107 |
| 5,339,546 | 8/1994 | Rahwan | 40/107 |

*Primary Examiner*—Andrea L. Pitts
*Assistant Examiner*—Monica Smith
*Attorney, Agent, or Firm*—Sheridan Ross P.C.

[57] ABSTRACT

The sorting and filing of particular items is achieved using an organizer and a method for organizing. An organizing device having a plurality of pocket enclosures correlating to a specific day of a week or month is provided. Pocket enclosures on each particular date have dimensions sufficient to retain physical items, such as envelopes, bills, etc. as well as additional pockets for miscellaneous materials. The organizing device is designed to hang over a door and may also include appliques to indicate numerals, color codes, appointments, etc.

8 Claims, 7 Drawing Sheets

DEVICE AND METHOD FOR ORGANIZING MATERIALS

RELATED APPLICATIONS

This application claims priority from Provisional Patent Application Ser. No. 60/044,153 filed on Apr. 23, 1997.

FIELD OF THE INVENTION

The present invention relates to an organizer and a method for organizing which relies upon sorting and filing of particular items that require action by specified time periods, and in particular, to a device and method for organizing personal and professional appointments, debts and obligations by providing a calendar format that provides spaces within which to hold desired physical information.

BACKGROUND OF THE INVENTION

Professional and personal demands on one's time have increased significantly during the last century with consequent difficulties in a person's ability to manage time effectively in order to comply with personal and professional obligations and duties. For example, the need to pay bills in a timely manner is imperative, given the significant ramifications of late payment with respect to credit reporting agencies and resulting difficulties that may be entailed due to tardy receipt by creditors of payments. Moreover, the ability to remember important dates with respect to birthdays, anniversaries and significant events in a person's life requires an effective system for noting such events in a manner that quickly and easily makes the recollection of such events a relatively simple function. While all members of the public are subject to faulty memories with respect to important events, children learning to coordinate their schedules independent of their parents could benefit greatly from a simple device and method that does not require special skills (e.g. the ability to use a personal computer, personal directory, time-keeping entry books, etc.). Similarly, given the advance of the "baby-boomers" into middle and old age, there is an increasing need for a simple and effective method to facilitate the recollection of events in a person's life that may have severe consequences if missed. For example, the onset of senility, Alzheimer's disease, etc. can exacerbate the frailties of human memory capabilities and can lead to significant problems if, for example, doctor or dentist appointments are missed, special family events are not attended or if insurance payments are not made by a specified date. The ability to avoid late charges for overdue debt obligations would reduce significantly the amount of money each individual must outlay in any given period of time. Late charges for overdue rental videos significantly contribute to the bottom line of many video rental organizations and thus, having a simple and effective method and device for recalling when particular video tapes are due would significantly reduce individual expenditures for such items.

There is, therefore, a long-felt but unsolved need for a simple and effective device and method for assisting individuals in recalling important events without the requirement that individuals be specifically trained on the use of computer devices and/or time diaries.

SUMMARY OF THE INVENTION

The present invention is directed to a device and method for organizing materials. In one embodiment, an organizing device is provided having a plurality of pocket enclosures wherein at least one of the plurality of enclosures correlates to a specific day of the month. Preferably, the pocket enclosures have dimensions sufficient to retain typical physical items, such as envelopes, bills, etc. and as such, such pockets have dimensions of at least about 3" in width to accommodate such items. In other embodiments, appliqués are applied to the front of each individual pocket to indicate, for example, specific numerical dates, special events as indicated by logos (e.g. doctor office visit, sporting events, etc.) and particular days of the week (M—Monday, T—Tuesday, etc.). In one particular embodiment, the organizing device is provided in the format of a calendar having seven days of one week extending the width of the organizing device itself and respectively numbered for each day of the month (e.g. 30/31). In another embodiment, appliqués can be reversibly attached to the organizing device to indicate specific days of the week that correlate to each numerical date. In use, for example, hook and loop (e.g. Velcro™) components can be applied to the organizing device to accommodate the changes in specific days of the week with each succeeding month. In yet other embodiments, a particular day of the week, for example Sunday, can be indicated by a particular appliqué on each Sunday of a given month (e.g. a red bar applied under the numerical date on each pocket to indicate each Sunday of the month).

In use, a person would provide an organizing device and would insert into one or more of the plurality of pocket enclosures physical items requiring some type of action on or about such date indicated on the pocket enclosure. On or about the date of a deadline, the person would then extract the particular information from the respective pocket and would take the appropriate action.

One embodiment of the present invention has pockets to accommodate reminder cards and a calendar card which indicates the various days and months of a given year. Devices depicting more than one month can be used to see at a glance responsibilities requiring action over a 60, 90, 120 day, etc. period of time. Two-sided devices (e.g. pocket enclosures on each side of the material) are also within the scope of the present rectangular invention. In addition, in one embodiment, pockets for holding extra envelopes, a pen, pencil, letter opener, checkbook, book of stamps, etc. are provided to provide a person with the requirements to organize mail, pay bills, and attend to other household or business paper items. Still additional embodiments include a pocket organizing system for children whereby appliqués, numbers, and other items provided on the front of each of the plurality of pockets is fashioned to appeal to a child's interests.

Other embodiments of the invention provide more than one month of dates on a particular organizing device. Still other embodiments provide for hourly pockets on a given day so that an individual can organize his/her day by inserting physical letters, and other items, in pockets indicated by the specific hours or half-hours of any given 24-hour period.

The present invention is a simple and effective method for individuals, particularly children and elderly individuals, to easily recall and organize materials that need specific action by particular time deadlines. The present invention avoids the need for individuals to learn more sophisticated time management skills utilizing computers, time diaries, calendar books, etc.

DETAILED DESCRIPTION OF THE INVENTION

Figure 1:
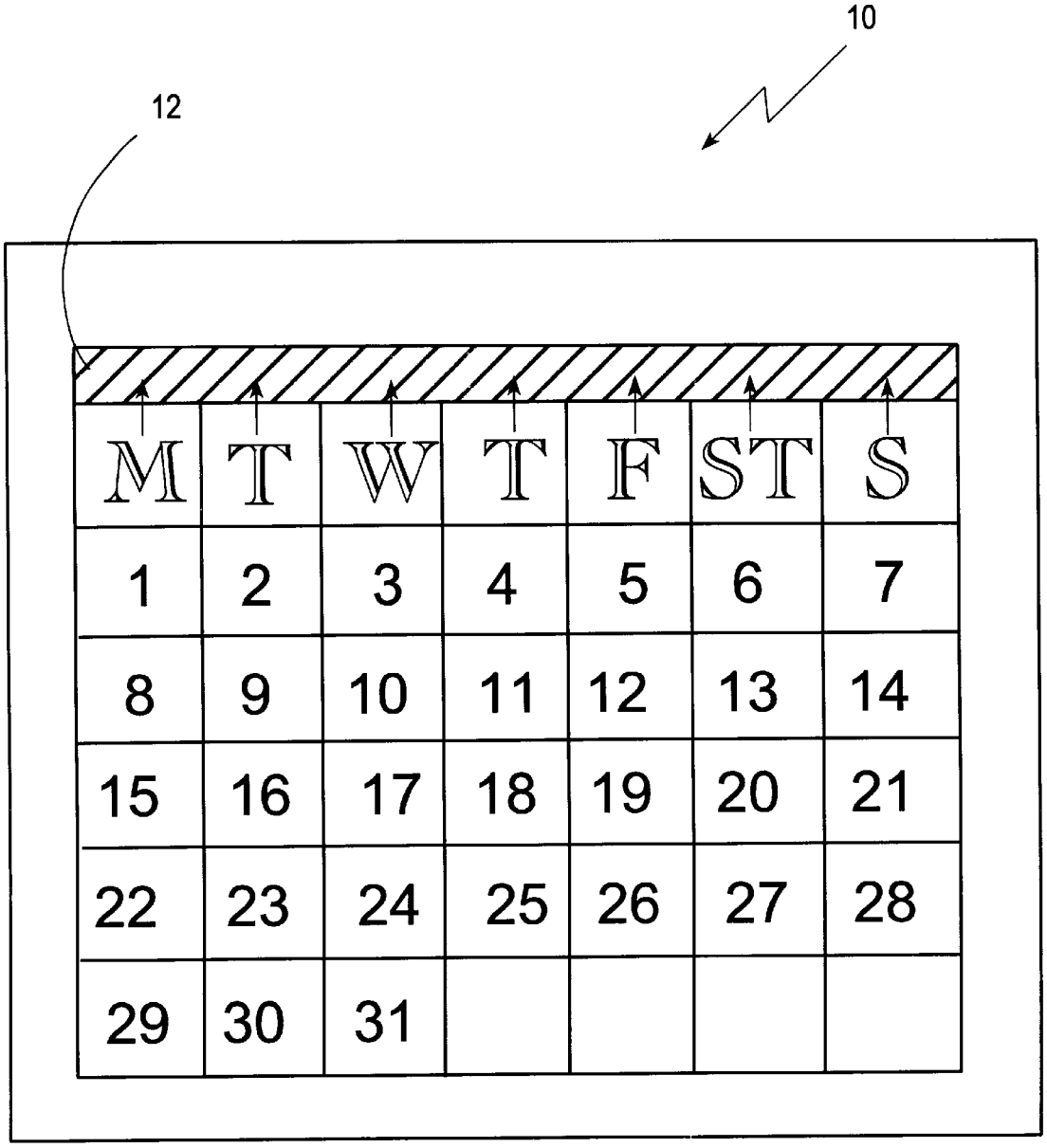
FIG. 1 shows an alternative embodiment of the present invention having reattachable numbers to facilitate the different days of the week in any given month.
Figure 2:
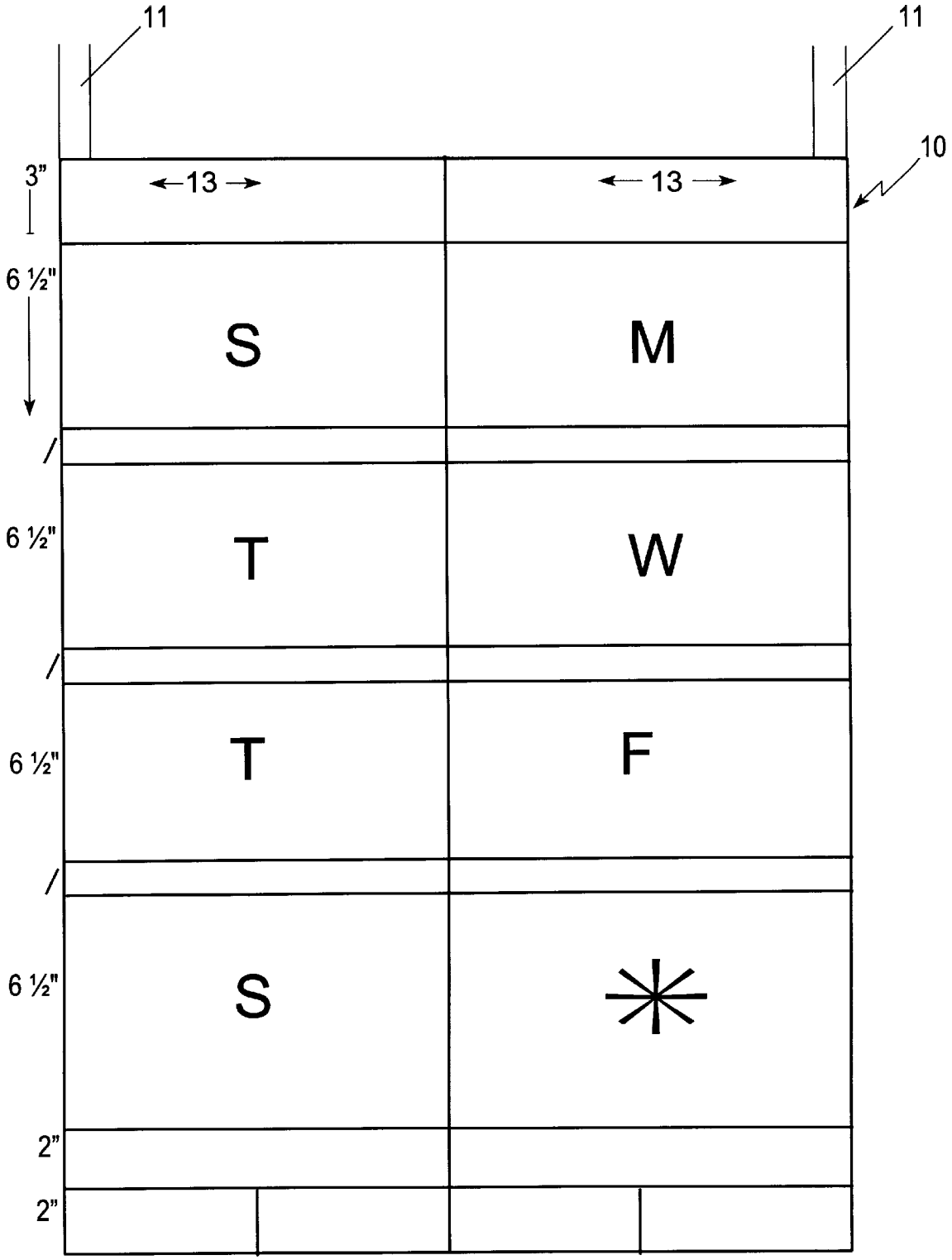
FIG. 2 shows one embodiment of the present invention showing pocket enclosures labeled with specific days of a week.
Figure 3:
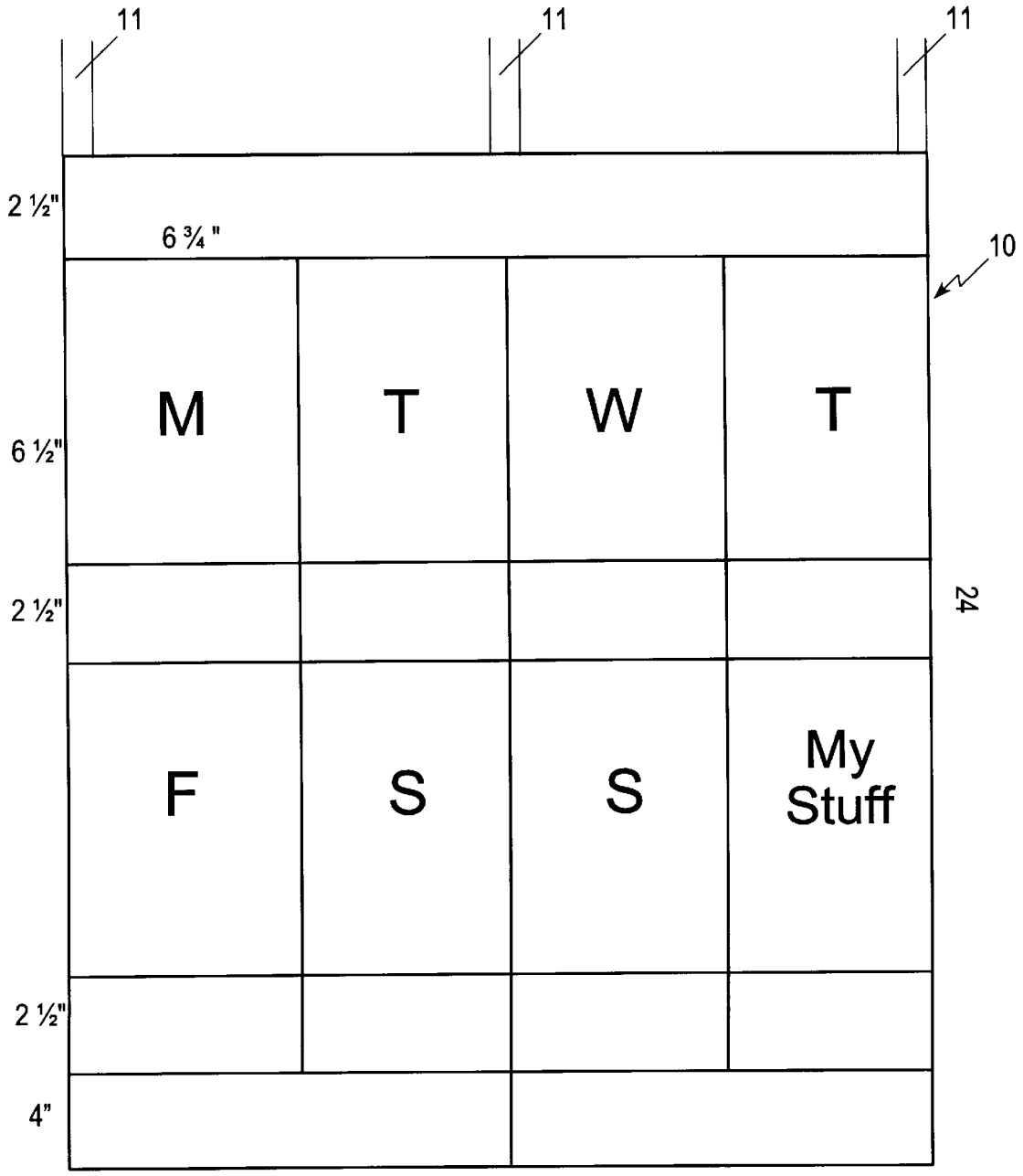
FIG. 3 shows an alternative embodiment of days of the week with a "kids pocket" and additional pockets included therewith.
Figure 4:
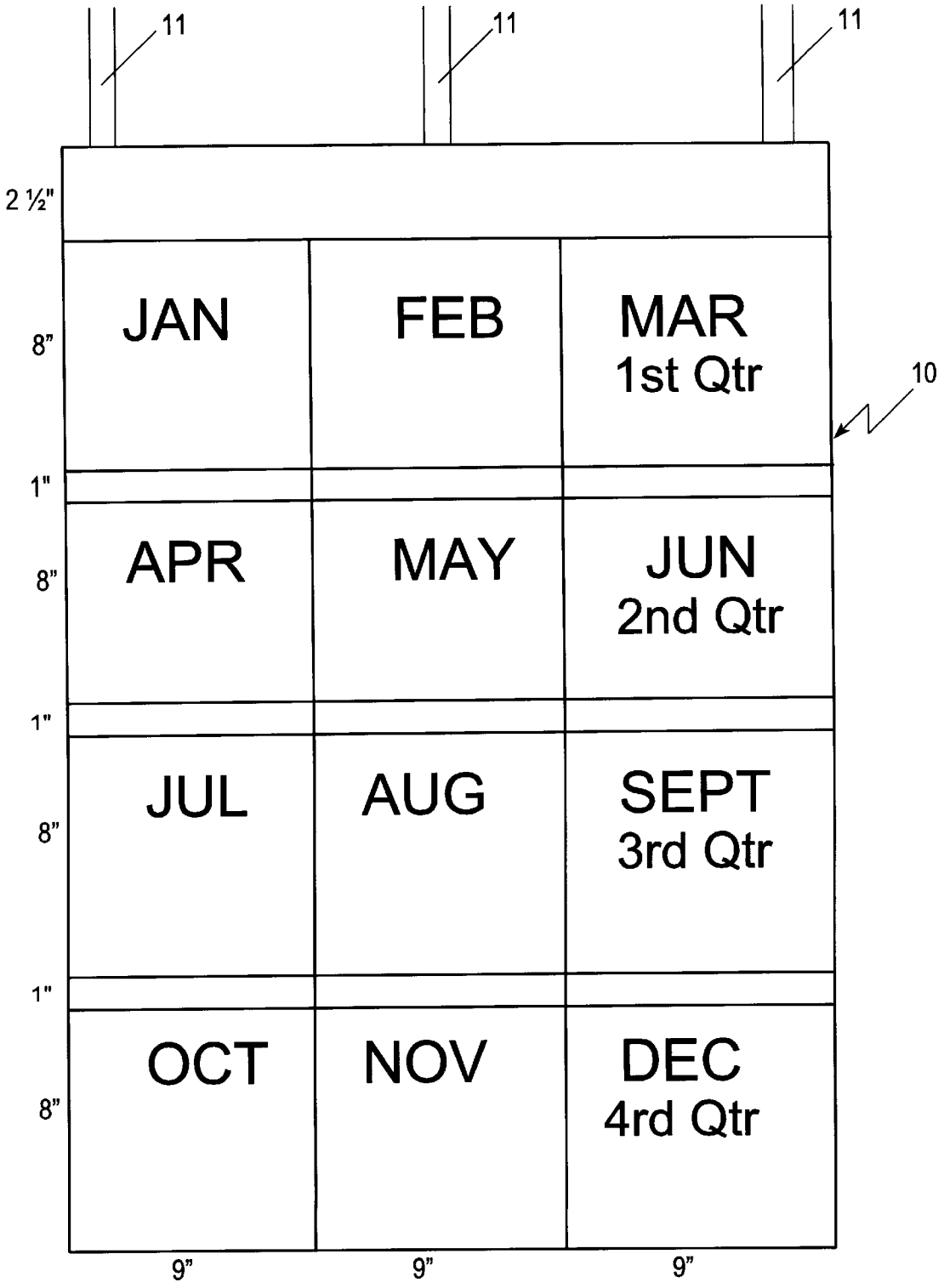
FIG. 4 shows an organizer of the present invention with specific pockets for particular months of a calendar year.
Figure 5:
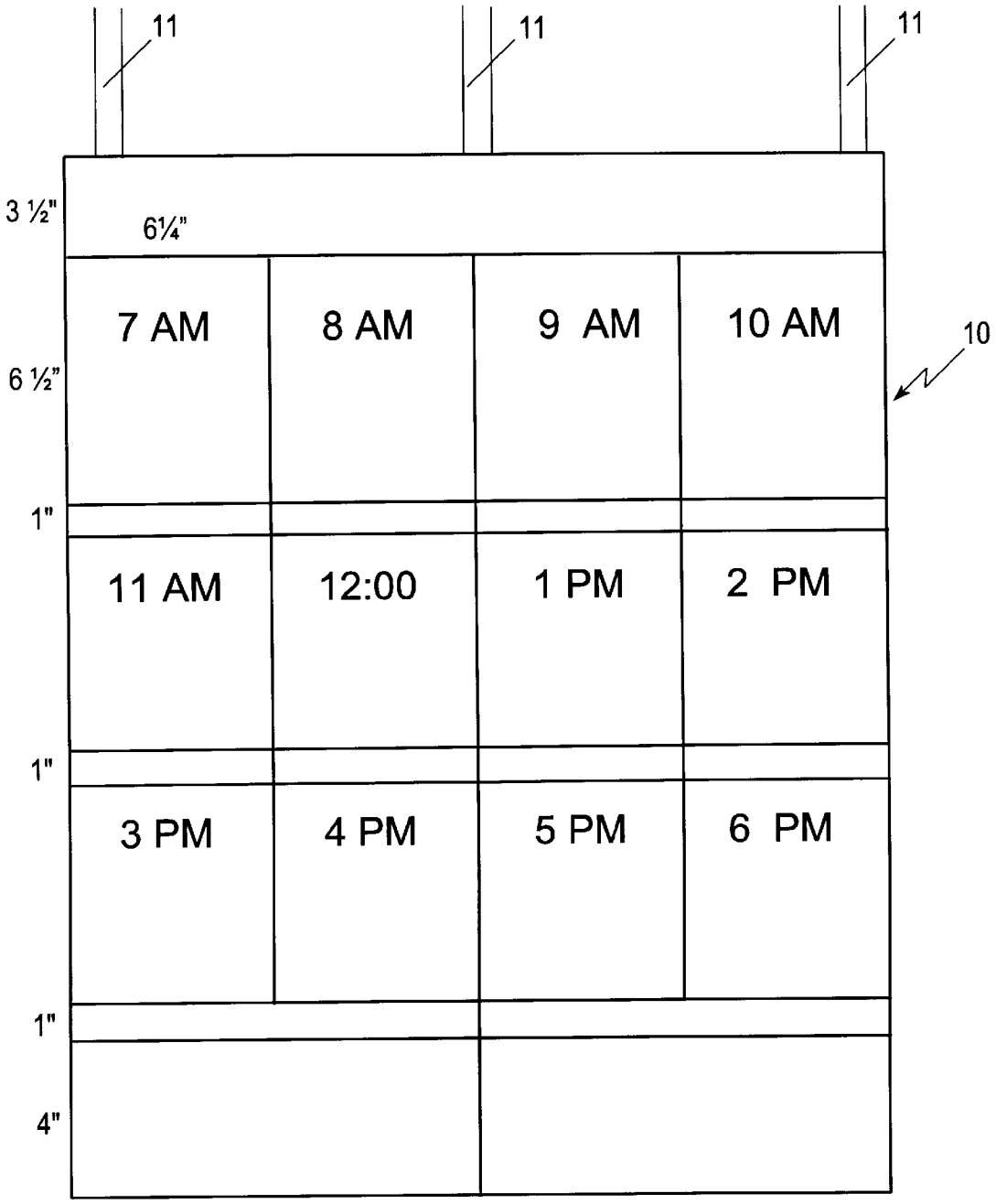
FIG. 5 indicates an hourly organizing device illustrating hours from 7 a.m. to 6 p.m.
Figure 6:
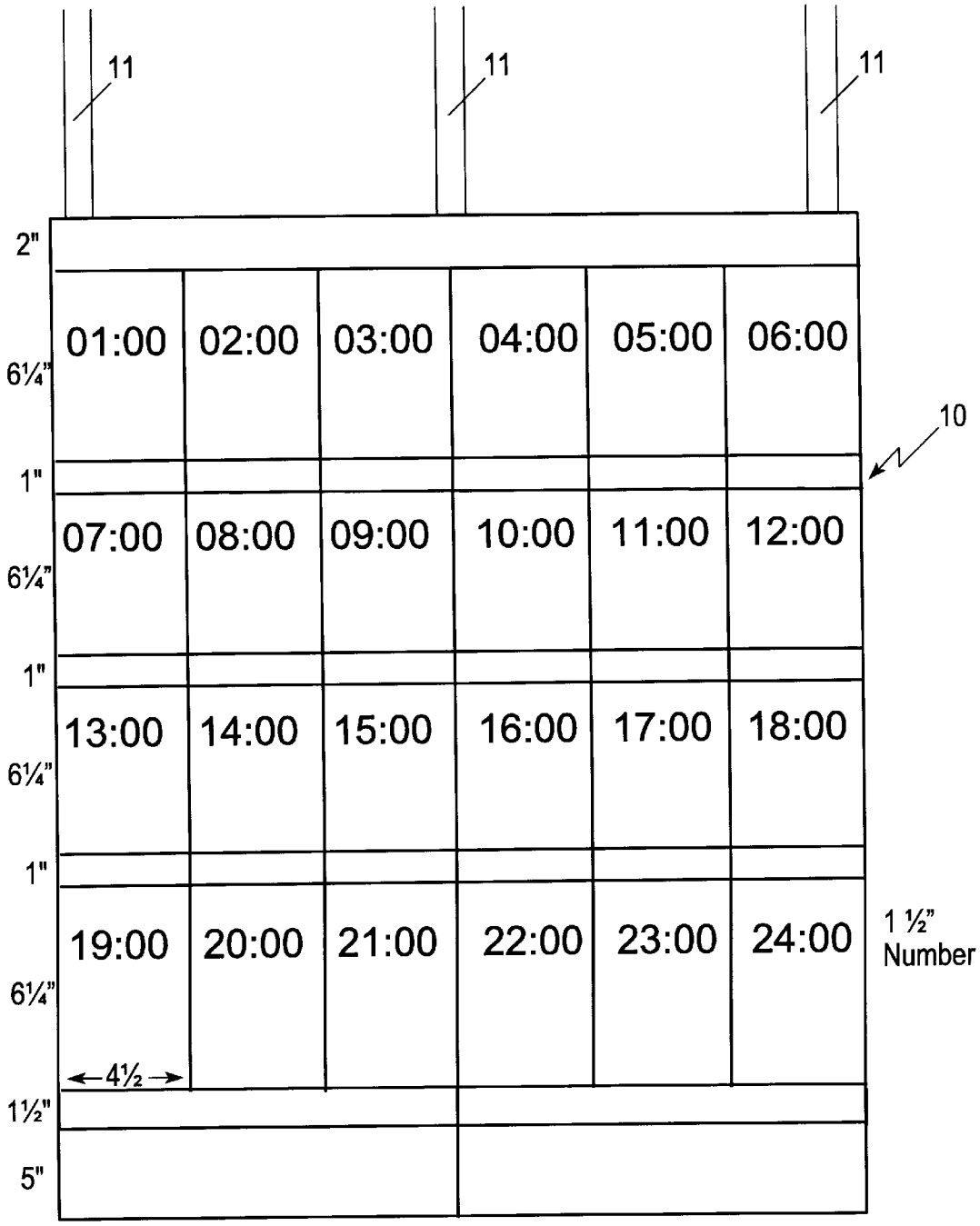
FIG. 6 shows one embodiment of the present invention indicating a 24-hour organizer with each particular pocket indicating a different hour of a 24-hour day.
Figure 7:
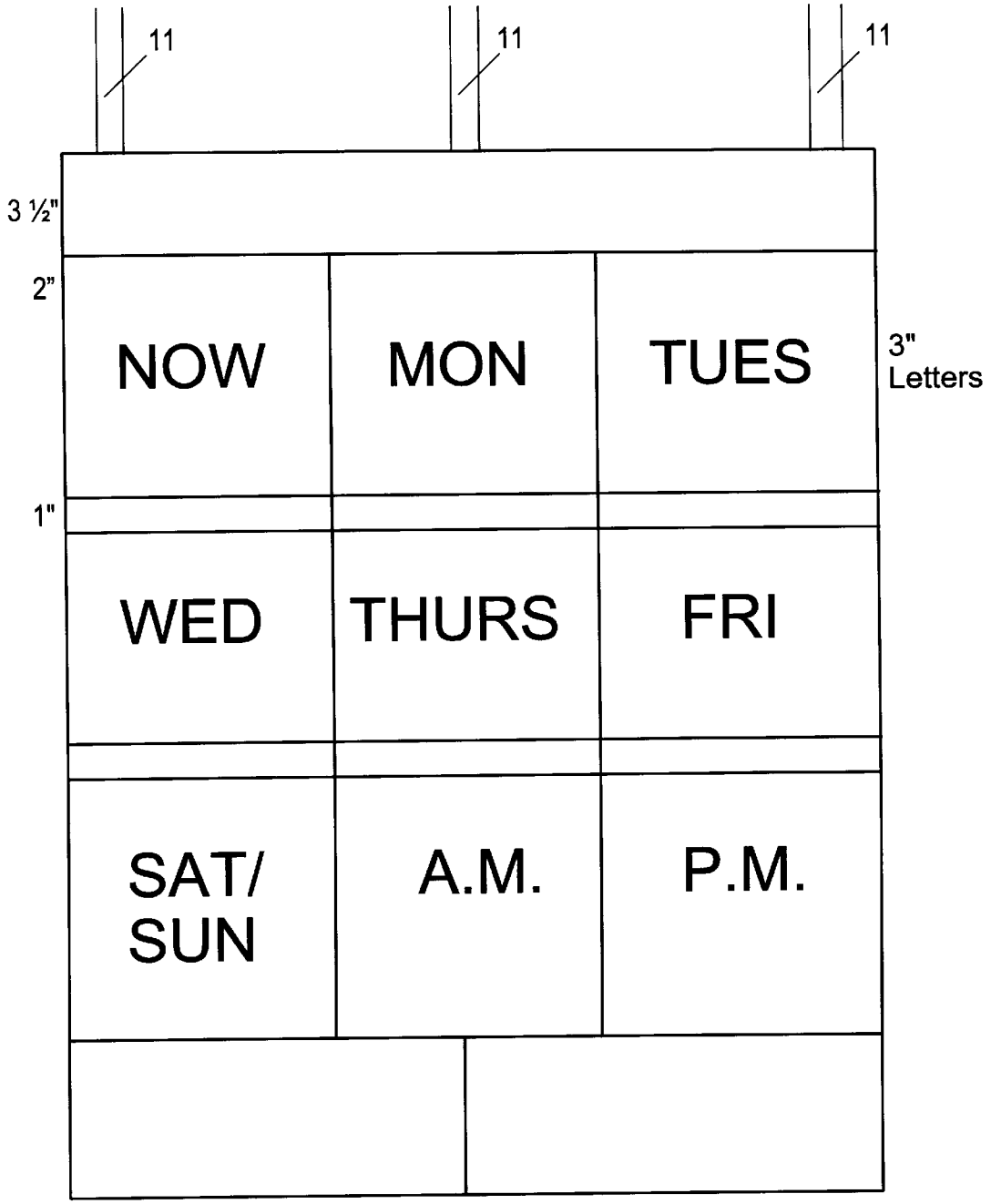
FIG. 7 shows an alternative embodiment of the present invention showing specific days of the week with additional pockets for a.m. and p.m. appointments.

In one embodiment of the present invention, a device 10 is provided that can hang from a door and that reflects particular time periods (e.g. the days of any given month) on its surface in such a manner that specific dates, hours, etc. can be correlated with important events. For example, in a particular embodiment of the invention a cloth rectangular piece of material is provided having a plurality of rows of individual pockets with each pocket having a discrete number affixed thereto, such as by printing, embossing, embroidery, etc. The individual pockets are dimensioned so as to accept standard sizes of envelopes (e.g. at least about 3" in width and more preferably at least about 5" in width). The depth of such pockets can vary but are most preferably at least about 3" and most preferably about 5" in depth. In other embodiments, the pockets are designed to expand to accommodate a volume of material within the pocket, for example, by pleating of the pocket material either along the sides of the pocket, the bottom of the pocket or along the front surface of the pocket.

While the present invention envisions the use of a plurality of pockets in any given arrangement, in one embodiment the number of pockets is dictated by the width of a door upon which the organizing device is hung. For example, although door widths vary, a typical door is approximately at least about two and one-half feet in width. The pockets spanning the width of the organizing device 10 generally span the entire width of the door so as not to impede the opening and closing of the door itself. Preferably, the organizing device 10 is narrower than the door width to avoid any interference with the door operation. At the uppermost top portion of the organizing device, straps, preferably of fabric, are provided which can be positioned over the top of a door and affixed to the other side of the door by tacks, adhesives, or any other appropriate securement means. In another embodiment, the present invention provides two rectangular organizing devices attached together by a piece of fabric at each organizing device's uppermost portions so that the two devices can be positioned so that one organizing device would hang on one side of the door and another counterpart device could hang on the other side of the door, thus providing two organizing devices on the same door, preferably reflecting different months, an hourly/day calendar, etc.

In one embodiment, the present invention provides an organizing device 10 having sequential numbers reflecting the dates of the month consecutively affixed or otherwise applied (e.g. screen printed) to the exterior of each individual pocket on the organizing device. In other embodiments, appliqués or clip-on components can be utilized to attach to the front of the pocket. Such appliqués may consist of specific numerals attachable by hook and loop structures (Velcro™, felt appliqués, adhesive components, etc.). In addition to affixing to the front of each pocket a numeral indicating a particular time period (e.g. the day of a month), additional appliqués can be affixed to the front of the pocket to indicate, for example, the particular events that may recur in a person's professional or personal schedule. For example, doctors appointments, birthdays of relatives, billing deadlines, sporting events, school events, etc., can be indicated on the outside of the pocket through the use of specially designed appliqués. For instance, the days of a soccer match could be indicated by applying an appliqué depicting a soccer ball to the front of any given pocket to remind an individual that on such date a soccer match will be held.

It should be understood that the present invention can be made from many various materials. For example, cloth, plastic, Mylar™, wood, metal, and any other suitable materials can be used with cloth and plastic being preferred given the flexibility of such materials.

In one embodiment, the organizer has straps 11 on its uppermost portion that can be thumb-tacked to the top of doors or push-pinned onto a wall or partition. Grommets can be installed on the straps 11 and the organizer can be hung from magnetic hooks on the side of a refrigerator, or on the side of walls. Other embodiments have the straps attached to a dowel which can be hung from hooks. Moreover, hook and loop structures can be sewn to the back of the organizer thus facilitating attachment of the organizer to fabric surfaces.

Pocket enclosure sections are preferably 5" deep and 4 ⅜" wide. The total dimensions of the organizing device is preferably 36 ¾" in length and 27 ½" in width. Bottom pocket sections are preferably 3 ¼" deep and 4 ⅜", 8 ¾", 11 ⅛" and 2" in width, so as to accommodate different size physical items. The bottom pocket section of the organizer is formed by folding up the bottom of the back of the organizing device, and as such, there is no hemming at the bottom of the organizer.

In one embodiment of the present invention numerals are permanently affixed to respective pockets on the organizing device with one pocket indicating a 30/31 to reflect different months having respectively 30 and 31 days. In one embodiment, the organizing device has six pockets extending across the width of the device (e.g. 1–6; 7–12; 13–18; 19–24; 25–30/31). In alternative embodiments, however, numerals can extend across the width in any given sequence, for example, 1–7, etc. to more accurately depict a standard calendar format. In order to indicate specific days of the week, various embodiments of the present invention provide, respectively, an appliqué to indicate Sundays (e.g. large, colored square that encompasses the specific numeral on the front of the pocket, thereby indicating all Sundays of a given month); appliqués indicating specific days of the week (e.g. M—Monday; T—Tuesday; W—Wednesday; R—Thursday; F—Friday; S—Saturday; S—Sunday), such appliqués 12 attached at the uppermost portion of the organizing device 10 to accurately reflect in a downward column the specific numerical dates that correspond to all Mondays of a given month, etc.

In a particular embodiment of the present invention, at least one additional row of pockets is provided either at the top, sides or bottom of the organizing device for miscellaneous documents that may not be appropriately placed in a given dated pocket. For example, a pocket can be utilized as a general "lost and found" pocket where individuals in the family can rely upon the organizing device as a place where lost items (e.g. jewelry, car keys, credit cards, etc.) can be placed so that other members in the family unit can locate such lost items with ease. These various pockets can be individually labeled respectively for their particular purported use (e.g. "lost and found", "car keys", etc.).

In practicing the method of organizing using the present invention, one would affix the organizing device 10 to a suitable substrate, preferably a vertical surface, such as a door (e.g. kitchen door, refrigerator door, office dividers, etc.), and would proceed to place into respective, dated pockets, information which requires action by an individual on such date. For example, if a credit card debt was owed on a particular day of the month, the credit card invoice and envelope could be placed in a respective pocket to indicate the due date of such invoice, anticipating the time required for mailing of such invoice. Similarly, special events such as doctor or dentist appointments, could be designated by placing preprinted cards into the appropriate pocket on the organizing device to remind an individual that a doctor and/or dentist is on that day. Included as part of the present invention, in one embodiment, are various colored cards with preprinted notices such as, for example, "Doctor", "Dentist", "Special Day", "Don't Forget", "To Do", etc.

In yet another embodiment of the present invention, smaller sized versions of the organizing device 10 can be provided to hang from the back of a chair, such an office chair.

The foregoing description of the present invention has been presented for purposes of illustration and description. Further, the description is not intended to limit the invention to the form disclosed herein. Consequently, variations and modifications commensurate with the above teaching, and the skill or knowledge of the relevant art are within the scope of the present invention. The preferred embodiment described herein above is further intended to explain the best mode known of practicing the invention and to enable others skilled in the art to utilize the invention in various embodiments and with various modifications required by the particular applications or uses of the invention. It is intended that the appended claims be construed to include alternative embodiments to the extent permitted by the prior art.

What is claimed:

1. An organizing device, comprising:

a device having a plurality of pocket enclosures, wherein at least one of said plurality of enclosures correlates to a specific time period, said enclosures having dimensions sufficient to retain physical items having dimensions of at least about 3" in width;

wherein each of said plurality of pocket enclosures has a specific numeral reversibly attached thereto.

2. The organizing device of claim 1, wherein each said plurality of pocket enclosures can accommodate appliqués indicating specific events of interest.

3. An organizing device of claim 1, wherein said device is provided with securing means to affix said device to a door.

4. The organizing device of claim 1, wherein said organizing device comprises first and second rectangular sheets of material connected at the uppermost portion of each of said first and second sheets of material, said device suitable for hanging over the top of a door so that said first sheet of material hangs on one side of the door and said second sheet of material hangs on the second side of the door.

5. An organizing device as set forth in claim 1, further comprising individual cards having a dimension suitable for fitting within said plurality of pocket enclosures, said cards having written instructions thereon informing an individual of particular events of interest.

6. The organizing device of claim 1, wherein said device further comprises an additional plurality of pocket enclosures without particular days of the month indicated thereon.

7. The organizing device of claim 1, wherein said plurality of pocket enclosures are expandable to accommodate an increased volume of physical material placed therein.

8. A method for organizing materials, comprising:

providing a device having a plurality of pocket enclosures wherein at least one of said plurality of enclosures correlates to a specific time period, said enclosures having dimensions sufficient to retain physical items having dimensions of at least about 3" in width, wherein each of said plurality of pocket enclosures has a specific numeral reversibly attached thereto;

placing in one or more of said plurality of pocket enclosures physical items which require an action to be taken on the time period specified on said pocket enclosure; and retrieving said physical item from one of said plurality of pocket enclosures on or about the date required for a particular action to be taken.

* * * * *